United States Patent [19]

Rosa

[11] Patent Number: 4,942,631

[45] Date of Patent: Jul. 24, 1990

[54] HAND SANITIZING STATION

[75] Inventor: Rudy Rosa, 3626 Baird Ct., Mississauga, Canada

[73] Assignees: Barry Robertson; Rudy Rosa, both of Ontario, Canada

[21] Appl. No.: 247,382

[22] Filed: Sep. 21, 1988

[30] Foreign Application Priority Data

Jun. 29, 1988 [CA] Canada ..... 570801

[51] Int. Cl.[5] ..... E03C 1/05

[52] U.S. Cl. ..... 4/623; 4/628; 4/630; 4/638

[58] Field of Search ..... 4/623, 638, 624, 620, 4/605, 628; 222/644, 132

[56] References Cited

U.S. PATENT DOCUMENTS

| | | | |
|---|---|---|---|
| 2,672,366 | 3/1954 | Deport | 4/628 |
| 2,962,728 | 12/1960 | Kuvin | 4/628 |
| 3,333,160 | 2/1964 | Gorski | 361/181 |
| 3,459,334 | 8/1969 | Evans | 222/132 |
| 3,505,692 | 9/1967 | Forbes | 4/623 |
| 3,556,146 | 3/1969 | Groen | 137/606 |
| 3,576,277 | 6/1969 | Curl | 222/1 |
| 3,639,920 | 2/1972 | Griffen et al. | 4/623 |
| 3,728,745 | 4/1973 | Brendgord et al. | 4/624 |
| 3,983,583 | 10/1976 | Herman et al. | 312/228 |
| 4,398,310 | 8/1983 | Lienhard | 4/623 |
| 4,563,780 | 1/1986 | Pollack | 4/192 |
| 4,606,085 | 8/1986 | Davies | 4/623 |
| 4,670,010 | 6/1987 | Dragone | 604/289 |
| 4,722,372 | 2/1988 | Hoffman et al. | 141/98 |

FOREIGN PATENT DOCUMENTS

| | | | |
|---|---|---|---|
| 2138676 | 10/1984 | United Kingdom | 4/605 |

*Primary Examiner*—Henry J. Recla
*Assistant Examiner*—Edward C. Donovan
*Attorney, Agent, or Firm*—Wegner & Bretschneider

[57] ABSTRACT

A sanitizing station suitable for use in institutional kitchens and the like includes a plumbing cabinet, a sink mounted on top of the cabinet and a spray manifold for spraying a sanitizing solution mounted above the sink. The solution is a mixture of water and a sanitizing chemical. A pump is used to inject the sanitizing chemical into a water pipe that is connected to the spray manifold. Tubing connects an outlet of this pump to the pipe. An infrared proximity switch mounted above the sink operates both the pump and a solenoid valve located in the water pipe for a preset period of time upon placement of the user's hands at a predetermined location above or in the sink. A covering hood can be mounted above the sink and it can provide support for the spray manifold and the switch.

20 Claims, 6 Drawing Sheets

HAND SANITIZING STATION

BACKGROUND OF THE INVENTION

This invention relates to sanitizing stations, particularly such stations suitable for use in an institutional environment such as a hospital or nursing home.

It is a well known fact that employees in food handling operations, such as large kitchens operated by institutions or companies, must have very clean hands. Government regulations, the public in general and customers demand that proper sanitation standards be met. It is not generally sufficient to simply wash hands with ordinary soap and water in many cases. In order to provide adequate safe guards, it is now known for food handlers to dip their hands into a pre-mixed germicidal solution after the usual washing with soap and water. However, this dipping method is not altogether satisfactory, being both messy and time consuming. Time is required to prepare the solution, to change the solution when required and to dispose of the used solution. Moreover, proper use of this solution is often not subject to adequate control by management. If the solution is not changed frequently due to human error or otherwise, this system can actually contribute to unsanitary conditions. A further problem with the known dipping method is that many employees and users do not like the method in that it requires them to dip their hands into a liquid that may have been previously used by many people.

The use of proximity switches to automatically turn on or off a water tap is known in the plumbing art. For example, U.S. Pat. No. 3,333,160 issued July 25, 1967, to A. Gorski describes a proximity responsive system that turns on a water tap when the user's hands are positioned close to the tap. More recent U.S. Pat. No. 3,576,277 issued Apr. 27, 1971, to Don Curl teaches an apparatus for control of wash water at different temperatures for scrubbing or washing in order to avoid contamination by contact with non-sterile surfaces. A beam of light is used for the switching apparatus. When the beam is broken power is routed through a relay energizing a coil and, lighting an indicator light. A second light beam is broken in order to obtain medium temperature water and a third light beam is broken to obtain cold water As far as the applicant is aware, proximity switches have not been used in the past to operate a device designed to spray a sanitizing solution onto the hands of the user in the manner of the present invention.

It is an object of the invention to provide a reliable and easy to use sanitizing device that employs a feed pump to deliver a sanitizing chemical concentrate to water in a pipe that is connected to a sprayer.

It is a further object of the invention to provide a sanitizing device that employs an electrical switch to operate the device upon placement of a user's hands at a predetermined location above or in a sink.

SUMMARY OF THE INVENTION

According to one aspect of the present invention, a sanitizing device comprises a sink, spray means for spraying a sanitizing solution located above the sink, and pipe means for delivering the solution to the spray means. The pipe means is adapted for connection to a source of water under pressure. An adjustable feed pump delivers a sanitizing chemical concentrate to water passing through the pipe means. A first tubing connects an outlet of the pump to the pipe means while a second tubing is connected at one end to an inlet of the pump and has an opposite end adapted for placement in a source of the concentrate. An electrical switch means operates the device upon placement of a user's hands at a predetermined location above or in the sink. This switch is operatively connected to the feed pump and to a valve controlling the flow of water through the pipe means.

According to a further aspect of the invention, a sanitizing device comprises a sink, a spray manifold with means for spraying a sanitizing liquid arranged thereon, and pipe means for delivering the liquid to the manifold. There is also provided pump means for providing a sanitizing chemical to the pipe means in order to produce the sanitizing liquid. Suitable means connect an outlet of the pump to the pipe means. An electrical switch operates the device upon placement of a user's hands at a preset location above or in the sink and this switch is electrically connected to the pump so that the latter operates when the hands are at the preset location.

Preferably the switch is an infrared proximity switch fixedly mounted above the sink. In a preferred embodiment, a covering hood is mounted above the sink and spaced therefrom. This hood contains and supports the spray manifold and the photoelectric proximity switch.

Further features and advantages will become apparent from the following detailed description when taken in conjunction with the accompanying drawings.

DETAILED DESCRIPTION OF PREFERRED EMBODIMENTS

Figure 1:
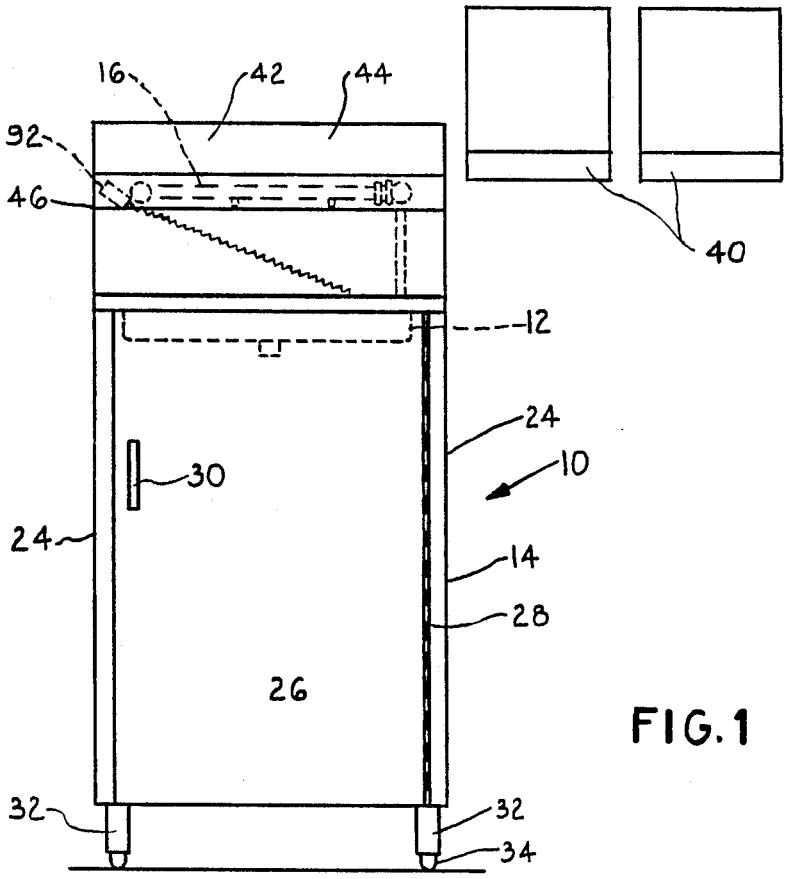
FIG. 1 is a front elevation of a sanitary station constructed in accordance with the invention.

The sanitizing device or station 10 shown in FIGS. 1 to 4 includes a sink 12 mounted on a plumbing cabinet 14, spray means 16 for spraying a sanitizing solution located above the sink and a pipe 18 for delivering this solution to the spray means. Extending down from the bottom of the sink 12 is a drain 20 constructed in the usual fashion. In the illustrated embodiment, this drain 20 is located at least in part in the cabinet 14 and is desirably concealed thereby.

The preferred plumbing cabinet 14 is made from 18 gauge stainless steel extending over a one inch square tubing frame work. The cabinet has two side walls 24 and a double-wall stainless steel door 26 at the front. The illustrated door is connected to the rest of the cabinet by a full height stainless steel piano hinge 28. As an alternative, upper and lower eccentric pins of known construction can be used to mount the door. In order to open the door, there is provided a recessed handle 30. The door can be held shut by a standard roller-type latch (not shown) if desired. The illustrated cabinet is mounted on four tubular stainless steel legs 32 with adjustable stainless steel bullet feet 34. If the cabinet is intended to be placed against a wall, the back of the cabinet can be left open and this permits easy attachment of the drain 20 and of the necessary water lines.

If desired, the present sanitary station can be used in conjunction with blower dryers 40 of known construction. These dryers can be operated by proximity switches if desired. With the use of such dryers, it is not necessary to use either disposable paper towelling or cloth towelling which can contribute to unsanitary or messy conditions. Such dryers are available from World Dryer Corporation of Berkeley, Illinois.

Mounted above the sink 12 is a stainless steel hood 42. Both the hood and the sink can be constructed of 18 gauge stainless steel all welded and polished. The illustrated hood has a sloping top surface 44, a short vertical front surface 46 and a narrow horizontal top surface 48. A downward extension 50 connects the hood to the back of the plumbing cabinet. The combination of the hood 42, sink 12 and extension 50 form an open-sided spray chamber into which the hands of a user are inserted for cleaning and sanitizing.

Figure 2:
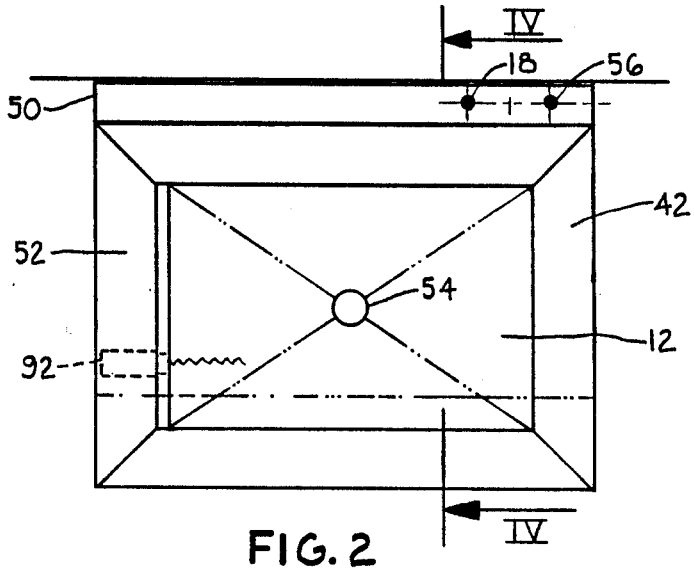
FIG. 2 is a top view of the sink in the sanitary station.

The preferred construction of the sink 12 is illustrated in FIG. 2. Preferably the periphery of the sink is formed with a slightly downwardly sloping drainage area 52 so that liquid falling onto this edge area will eventually drain into the sink. The drain hole 54 is located in the center of the sink. Extending up behind the sink inside the extension 50 is the water pipe 18 and optionally a second water pipe 56, the purpose of which is described hereinafter.

Figure 3:
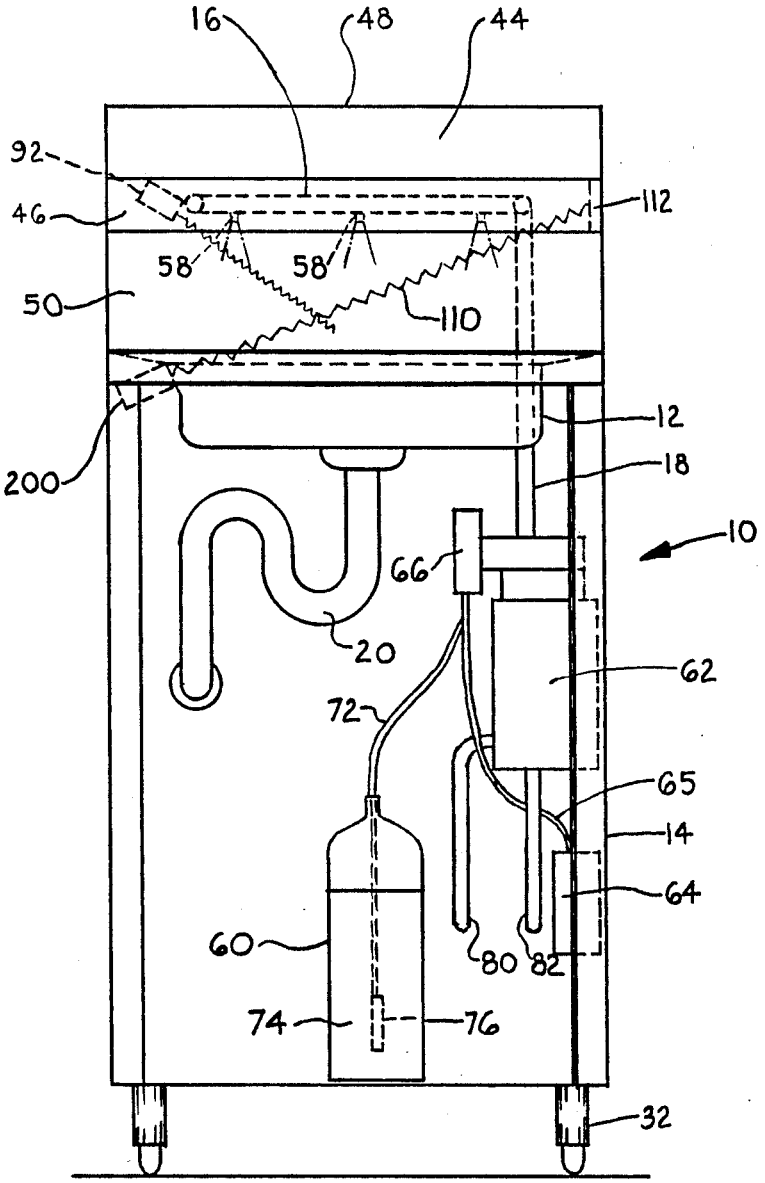
FIG. 3 is a front elevation of the station of FIG. 1 with the door of the plumbing cabinet removed for sake of illustration.

The preferred spray means 16 is a removable PVC spray manifold with removable brass spray jets 58. A stainless steel manifold would also be satisfactory. These jets can be distributed as indicated in FIG. 3 along the length of the manifold. These jets spray a sanitizing solution or liquid which is a mixture of water and a sanitizing chemical which can be purchased in a disposable container 60 illustrated in FIG. 3. One sanitizing chemical or agent that is often used for this purpose is an iodine-based concentrated solution that can be mixed with water at a ratio of about 600 to 1. One suitable solution is that sold under the trade name or trade mark MICRO-KLEAN by Economics Laboratoris. Such agents are also produced by Diversey (sold under trade name Adage II), DuBois and Kert Chemical.

The preferred plumbing for the sanitizing station of the invention will now be described with particular reference to FIGS. 3 and 5. In particular, there is an adjustable feed pump 62 that can be mounted on one side wall of the plumbing cabinet. A suitable metering pump for this purpose is a series C-1500 P pump sold by Bluewhite Industries of Westminister, California. The pump is connected to a standard 120 volt alternating current power source at a junction box 64 which can also be mounted to the wall of the plumbing cabinet. Electrical line 65 extends from the box 64 to the junction box 66 of the pump. The outlet of the pump is connected by a first tubing 68 to the water pipe 18 through a check valve 70. The check valve 70 prevents the water in the line 18 from entering the tubing 68 when the pump is not operating. A second tubing 72 is connected at one end to the inlet of the pump 62 and its opposite end extends into the container 60 which contains the chemical concentrate 74. The tubing 72 can be vinyl suction tubing and it is arranged in the container 60 so that its bottom end is two or three inches from the bottom of the container. A foot strainer/bulk head fitting 76 is connected to the inlet end of the tubing 72.

Preferably the pipe 18 is connected to sources 80 and 82 of cold and hot water under pressure. The pipes for this water are brought into the back of the cabinet as illustrated in FIG. 3. Preferably each of the two sources of water is controlled by its own throttling valve 84. Downstream from each throttling valve is a check valve 86 and downstream from these check valves is a suitable pipe junction 87 where the hot and cold water mix. Downstream from the junction 87 is a line strainer 88 and an electrically operated solenoid valve 90. This valve 90 is operated by a proximity switch 92 located above the sink, which switch is described further hereinafter. Thus, closure of the valve 90 will completely cut off the flow of water to the spray manifold. Located downstream from the valve 90 is a further check valve 98 which is located upstream from the point where the chemical concentrate enters the water in the pipe.

Figure 5:
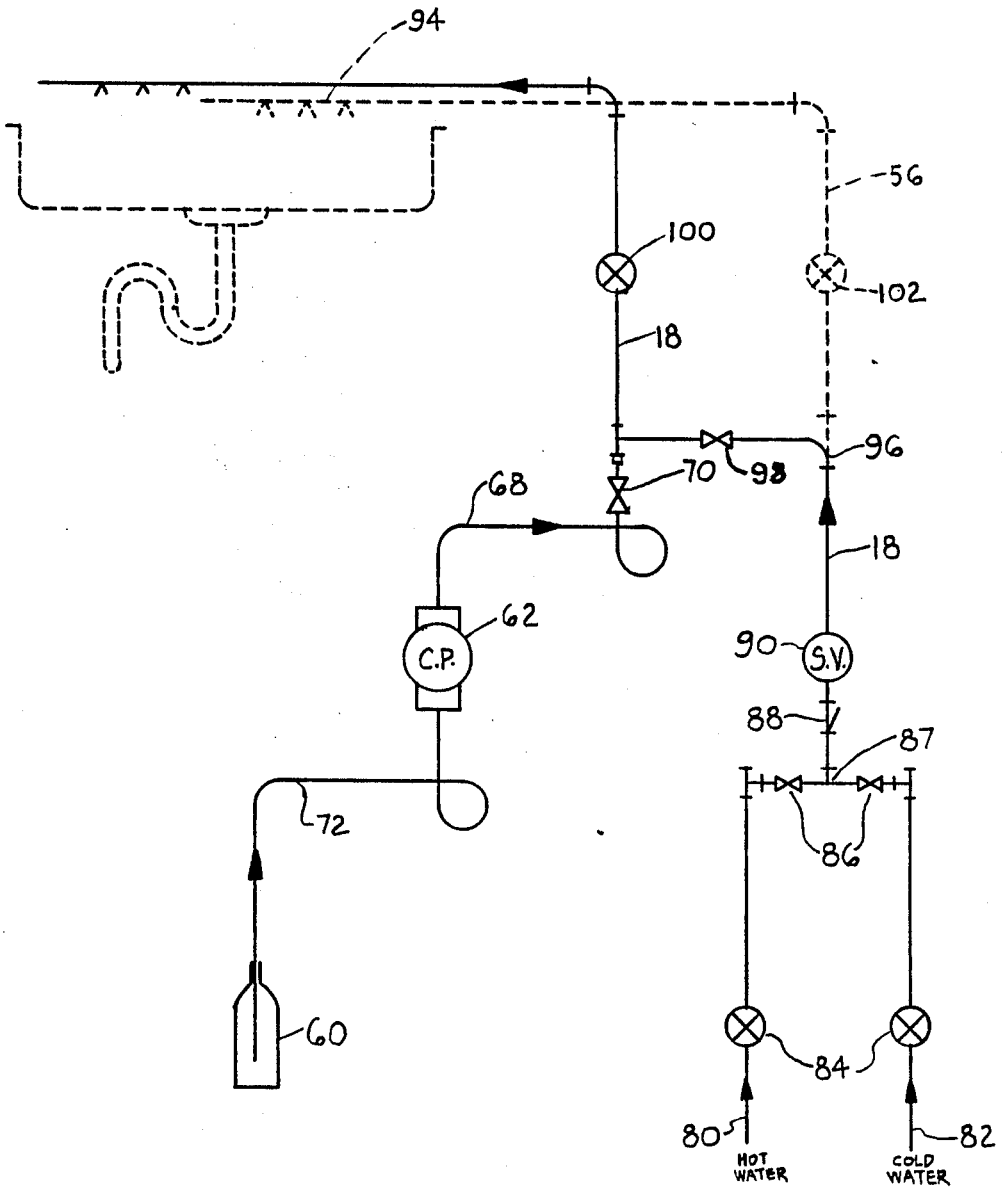
FIG. 5 is a schematic illustration of the plumbing components used in the preferred station.

FIG. 5 also illustrates an optional feature of the present invention comprising further spray means 94 and a further pipe 56 connected thereto. The spray means 94 in the form of a spray manifold with spray jets is used to provide an optional clear water rinse that can be used to remove the sanitizing solution from the user's hands. The pipe 56 is connected by a suitable pipe junction at 96 to the pipe 18 so that the flow of water to the spray manifold 94 is also controlled by the solenoid valve 90. In the illustrated arrangement therefore the clear water rinse is provided at the same time as the sanitizing spray. The two sprays are separated by having the clear water rinse arranged above the right hand side of the sink (as shown) while the sanitizing spray is on the left hand side of the sink. Both sprays start automatically when the user's hands are placed in the spray area and the sprays stop automatically after a built-in delay period.

Optionally, a further throttling valve 100 is provided in the pipe 18 downstream of the check valves 70 and 98. Another throttling valve 102 can also be provided in the pipe 56.

Figure 4:
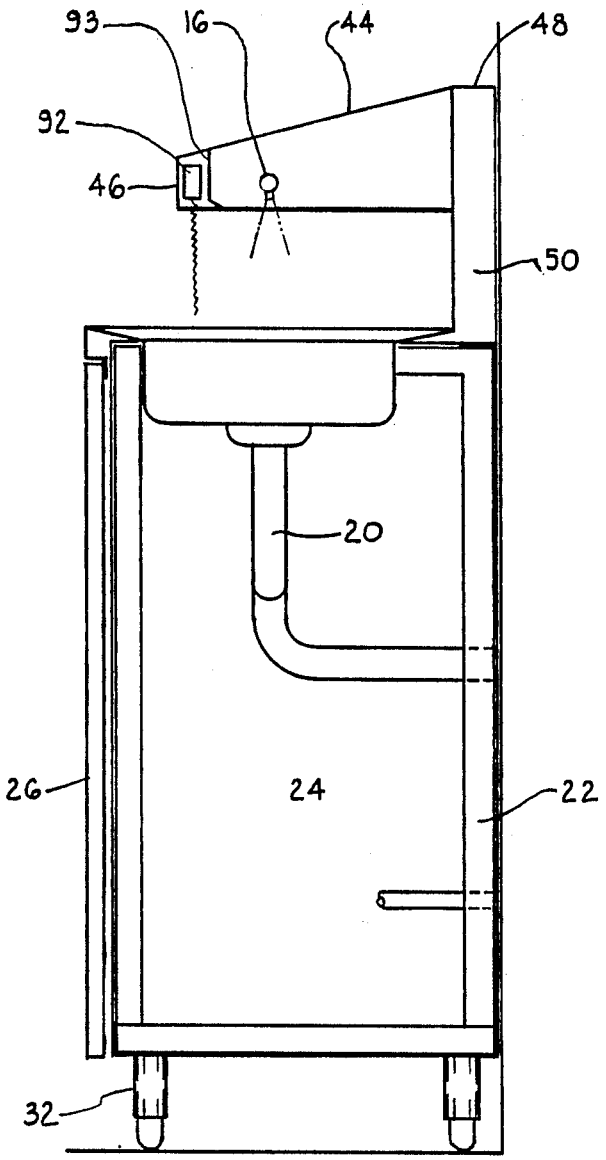
FIG. 4 is a sectional elevation of the station taken along the line IV—IV of FIG. 2.

The electrical switch used to operate the sanitizing station of the invention is preferably an infrared proximity switch 92 mounted above the sink as shown. In the illustrated version, this switch is mounted to one side of the hood 42 but it could also be mounted at the back of the sink, for example, along the extension 50. As shown in FIG. 4, it can be mounted at the front of the hood and protected from water spray or splashes by a stainless steel metal deflector 93 that is mounted to the side of the hood. Such switches are well known in the switching art and therefore further description of the construction of the switch is deemed unnecessary. A suitable switch is that sold under the trade mark MINI-BEAM by Banner Engineering Corporation of Minneapolis, Minnesota. This unit has Model No. SM2A312D and is a self-contained two wire AC diffuse sensor having a 12" range.

An alternate electrical switch that can be used in the present sanitizing station is one employing a photoelectric cell 200. This cell 200 can be mounted at the side of the sink as indicated in dashed lines in FIG. 3 and it emits a light beam 110 which is reflected off of a suitable reflector 112 mounted on the front of the hood 42. The switch is open and will not operate the solenoid valve and the chemical pump when the light beam is reflected back to the cell but when the light beam is interrupted by a user's hands, the switch will close in order to operate both the pump and the solenoid valve. Again, such photoelectric cell switches are well known in the switching art and a further description of such a switch is deemed unnecessary at this time.

Figure 6:
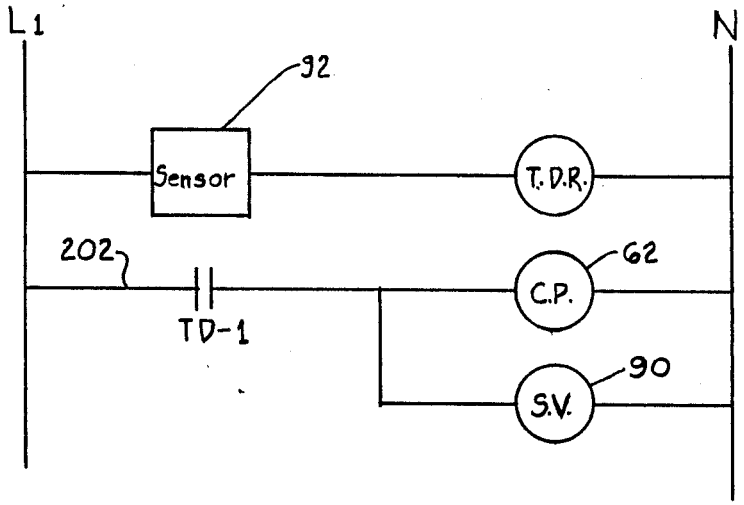
FIGS. 6, 7 and 8 are electrical circuit diagrams showing three possible circuits to operate the chemical feed pump and the solenoid valve of the system.

Turning now to the electrical circuit diagram of FIG. 6, the sensor proximity switch 92 is connected to a 120 volt power source via electrical wires $L_1$ and N and is dark operated. This sensor is activated by the presence of a user's hands which causes power to flow through it. This flow of power activates the time delay relay TDR which in turn closes the contacts of TD-1 (part of the TDR unit). This causes power to flow to the feed pump 62 and the solenoid valve 90. The TDR unit has a time delay range between 0 and 5 seconds and is preferably set for a time delay of 2.5 seconds. Such units are available from Omron or Scantimer. Thus 2.5 seconds after the user's hands are removed from the sensing area the contacts of TD-1 are automatically opened, stopping operation of the pump and closing the valve 90. When the user's hands have been removed from the region of the sink, the sensor or switch 92 will switch off and stop the flow of power to TDR. However, current will continue to flow to the pump 62 and the valve 90 for the preset period of time through the line 202 and TD-1.

Figure 7:
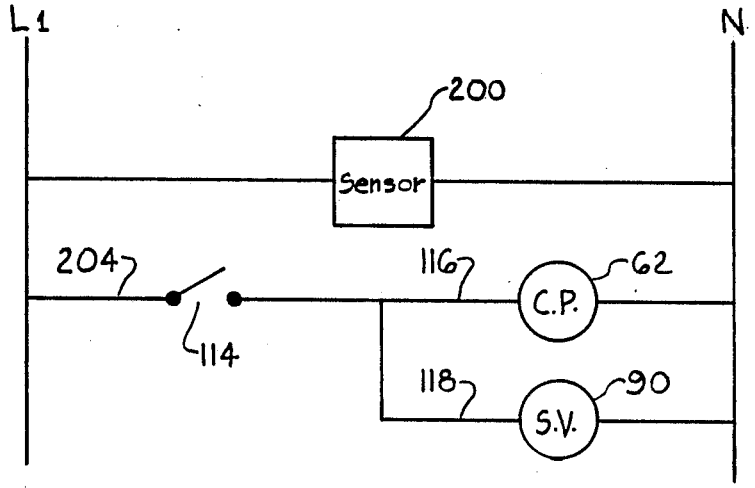

FIG. 7 illustrates the electrical circuit that can be used in conjunction with a photoelectric cell sensor 200. In this circuit, the sensor 200 has a built in time delay off and the sensor is dark operated by choosing the appropriate setting on the sensor. Thus the placement of the user's hands above the sink will activate the sensor and cause power to flow through it. This will close the switch 114 and power will flow through the line 204 and to both the feed pump 62 and the solenoid valve 90. As in the version of FIG. 6, the time delay in the sensor 200 is set at 2.5 seconds approximately. Thus after removal of the user's hands from the sensing area, the sensor 200 will deactivate and 2.5 seconds later the switch 114 will be opened causing the pump and the valve to cease operation.

Figure 8:
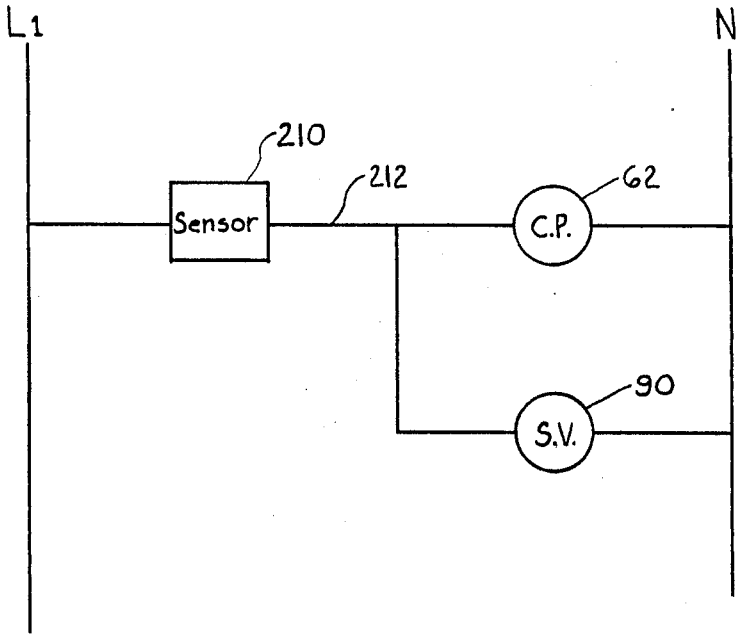

In the simple circuit diagram of FIG. 8, the sensor/-proximity switch 210 has a built-in time delay off relay. A large unit of this type is commercially available. The unit 210 is connected by a line 212 to the feed pump 62 and the solenoid valve 90. Again, the preferred time delay setting would be about 2.5 seconds. It will be understood that this electrical circuit would operate in a similar manner to the FIG. 6 circuit. In other words, the insertion of the hands in the sensing area of the sensor 210 would cause it to be activated and would cause power to flow through it and its built-in relay to operate the feed pump and the solenoid valve. Removal of the hands would cause the sensor to deactive but because of the time delay power would continue to flow through the contacts of the relay for the preset period of time.

Figure 9:
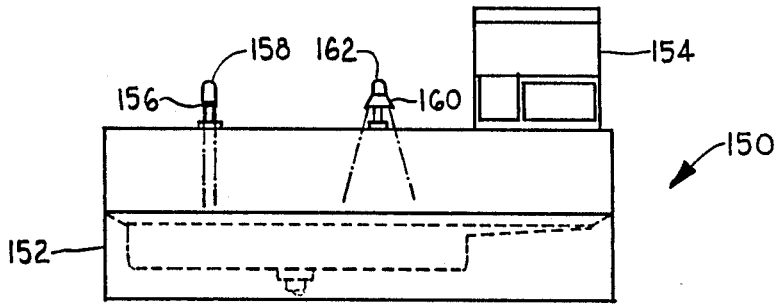
FIG. 9 is a front view of another embodiment of a sanitary station.

FIG. 9 illustrates an alternative sanitizing device which is wall mounted. In the sanitizing device 150 there is a sink unit 152 and an adjacent blow dryer 154. At the left hand side of the sink there is a sprayer 156 for the sanitizing solution, which sprayer is mounted on the end of a standard faucet 158. This faucet is connected by a pipe to a source of water under pressure. The means for providing the sanitizing solution in this embodiment is otherwise the same as the embodiment shown in FIGS. 1 to 4. In this version, there is also a second sprayer 160 connected to a standard faucet 162 which provides a clear water rinse on the right hand side of the sink. In this unit there is no hood provided above the sprayers.

From the above description it will be seen that the present invention provides a hand sanitizing station which does not require the user to contact any unsanitary surfaces during the use thereof. Moreover, this station avoids the need to dip one's hands into a liquid sanitizing solution.

Various modifications and changes could be made to the described hand sanitizing station without departing from the spirit and scope of this invention. All such modifications and changes as fall within the scope of the appended claims are intended to be part of this invention.

I therefore claim:

1. A sanitizing device comprising as sink, spray means for spraying a sanitizing solution containing water located above said sink, pipe means for delivering said sanitizing solution to said spray means, said pipe means being adapted for connection to a source of water under pressure, an electrically operated valve for controlling the flow of water through said pipe means, said valve when open permitting water to flow therethrough, a feed pump for delivering a sanitizing chemical concentrate to water passing through said pipe means, first tubing connecting an outlet of said pump to said pipe means, second tubing connected at one end to an inlet of said pump and having an opposite end adapted for placement in a source of said concentrate, and electrical switch means for operating said device, said switch having both an off and an on condition and switching to the one condition upon placement of a user's hands at a predetermined location near said sink, said switch being operatively connected to both said feed pump and said valve and in the on condition causing both said valve to pen and said feed pump to operate simultaneously, wherein said concentrate mixes with the water in said pipe means to form said sanitizing solution.

2. A sanitizing device according to claim 1 wherein said switch means is an infrared proximity switch mounted in the region of said sink.

3. A sanitizing device according to claim 2 wherein said pipe means is connected to sources of cold and hot water under pressure and said valve controlling the flow of water is a single solenoid valve mounted in said pipe means downstream of a pipe junction where the cold and hot water are mixed.

4. A sanitizing device according to claim 2 including further spray means and further pipe means connected thereto, said further spray means being mounted above said sink and adapted to provide a spray rinse and said further pipe means being connected to a source of water under pressure.

5. A sanitizing device according to claim 1 including a hood mounted above said sink and containing said spray means, said hood and sink together forming an open-sided spray chamber.

6. A sanitizing device according to claim 1 including a plumbing cabinet on which said sink is mounted, said cabinet containing said feed pump and said first and second tubing and having space to accommodate said source of said concentrate.

7. A sanitizing device according to claim 1 including said source of chemical concentrate in the form of a disposable container with a quantity of liquid sanitizing chemical therein, said opposite end of said second tubing being disposed in said chemical in said container.

8. A sanitizing device according to claim 1 including a plumbing cabinet on which said sink is mounted, a drain connected to the bottom of said sink and located at least in part in said cabinet, and said source of chemical concentrate.

9. A sanitizing device comprising a sink, a spray manifold with means for spraying a sanitizing liquid containing water arranged thereon, pipe means for delivering said liquid to said manifold, said pipe means being adapted for connection to a source of water under pressure at one end; an electrically operated valve for controlling the flow of water through said pipe means, said valve in an open position permitting water to flow therethrough, pump means for injecting a sanitizing chemical into water in said pipe means in order to produce a mixture of said chemical and water comprising said sanitizing liquid; means for connecting an outlet of said pump means to said pipe means; and electrical switch means for operating said device, said switch having an off and an on condition and switching to the on condition upon placement of a user's hands at a preset location near said sink, said switch being electrically connected to both said pump means and said valve and in the on condition causing both said pump means to operate and said valve to open.

10. A sanitizing device according to claim 9 wherein said switch is an infrared proximity switch fixedly mounted above said sink.

11. A sanitizing device according to claim 10 including a disposable container having a quantity of said sanitizing chemical therein and a plumbing cabinet on which said sink is mounted, said container being located in said cabinet.

12. A sanitizing device according to claim 10 including a covering hood mounted above said sink and spaced therefrom, said hood containing said spray manifold and said switch.

13. A sanitizing device according to claim 10 wherein said pipe means is connected to sources of both hot and cold water under pressure.

14. A sanitizing device according to claim 10 wherein said valve is to a solenoid valve controlling the flow of water through said pipe means.

15. A sanitizing device according to claim 9 including a second spray manifold with means for spraying a rinsing liquid arranged thereon and further pipe means for delivering said rinsing liquid to said second manifold.

16. A sanitizing device according to claim 9 including tubing connected to an inlet of said pump means at one end, the other end of said tubing being placed in said chemical in a container.

17. A sanitizing device according to claim 9 including a plumbing cabinet on which said sink is mounted, said cabinet containing said pump means and having accommodating space for a container of said sanitizing chemical.

18. A sanitizing device comprising a plumbing cabinet, a sink mounted on top of said cabinet, a spray manifold for spraying a sanitizing solution mounted above said sink, said solution comprising a mixture of water and a sanitizing chemical, a pump for said sanitizing chemical, pipe means connected to said spray manifold at one end and adapted for connection to a source of water under pressure at the other end thereof, an electrically operated valve for controlling the flow of water through said pipe means, said valve when open permitting water to flow therethrough, means for connecting an outlet of said pump to said pipe means whereby said pump can inject said chemical into water in said pipe means to form said solution, and an infrared proximity switch mounted above said sink and adapted to operate said device, said switch having both an off and an on condition and switching to the on condition upon placement of a user's hands at a predetermined location near said sink, said switch being electrically connected to both said valve and said pump and in the on condition causing both said valve to open and said pump to operate.

19. A sanitizing device according to claim 18 including a covering hood mounted above said sink and supporting said spray manifold and said proximity switch.

20. A sanitizing device according to claim 18 wherein said valve is a solenoid valve.

* * * * *